US006716118B1

(12) United States Patent
Asta

(10) Patent No.: US 6,716,118 B1
(45) Date of Patent: Apr. 6, 2004

(54) GOLFING AID AND METHOD

(76) Inventor: Joseph C. Asta, 9280 N. Hampshire, Tucson, AZ (US) 85742

( * ) Notice: Subject to any disclaimer, the term of this patent is extended or adjusted under 35 U.S.C. 154(b) by 316 days.

(21) Appl. No.: 09/326,996

(22) Filed: Jun. 7, 1999

(51) Int. Cl.[7] ..... A63B 57/00
(52) U.S. Cl. ..... 473/406; 473/408; 473/286
(58) Field of Search ..... 473/286, 386, 473/406, 408, 285; 294/19.1, 19.2; 206/315.7

(56) References Cited

U.S. PATENT DOCUMENTS

| | | | | | |
|---|---|---|---|---|---|
| 2,979,335 | A | * | 4/1961 | Pruitt | 473/285 |
| 4,021,068 | A | * | 5/1977 | Piazza | 294/19.2 |
| 4,466,650 | A | * | 8/1984 | Roedel | 473/386 |
| 5,116,046 | A | * | 5/1992 | Pace | 473/286 |
| 5,149,087 | A | * | 9/1992 | Thompson, Jr. | 473/286 |
| 5,165,744 | A | * | 11/1992 | Vogrin | 473/386 |
| 5,335,953 | A | * | 8/1994 | Luther, Sr. | 294/19.2 |
| 5,383,659 | A | * | 1/1995 | Taylor | 473/286 |
| 5,437,449 | A | * | 8/1995 | Zink | 473/286 |
| 5,759,117 | A | * | 6/1998 | Erickson, Jr. | 473/386 |
| 6,290,617 | B1 | * | 9/2001 | Cole et al. | 473/408 |

* cited by examiner

*Primary Examiner*—Steven Wong
(74) *Attorney, Agent, or Firm*—Durando Birdwell & Janke, PLC

(57) ABSTRACT

A golfing aid includes an elongated cylindrical member having a passage which runs the length thereof. One end of the cylindrical member is provided with a resilient cup-like element designed to grip a golf ball. A rod extends through the cylindrical member and projects from the other end thereof. The projecting part of the rod is formed with a knob which is urged away from the cylindrical member by a spring. When the spring holds the knob away from the cylindrical member, the rod is in a retracted position in which the end of the rod opposite the knob is inside the cylindrical member. The knob can be depressed against the action of the spring to move the rod to an extended position in which the end of the rod opposite the knob projects into the cup-like element to eject a golf ball therefrom. A magnetic or magnetizable button on the knob holds a magnetic or magnetizable washer serving as a marker. The end of the rod opposite the knob is also magnetic or magnetizable thereby permitting the washer to be placed on this end of the rod in the extended position. The washer is larger than the passage in the cylindrical member so that retraction of the rod causes the washer to fall off the rod and permit marking of the golf ball.

12 Claims, 2 Drawing Sheets

GOLFING AID AND METHOD

BACKGROUND OF THE INVENTION

1. Field of the Invention

The invention relates to a golfing aid.

2. Description of the Prior Art

The game of golf involves a considerable amount of bending. Thus, at the beginning of each hole, the ball must be placed on a tee. Furthermore, when the ball is driven or chipped onto a green, or when the ball is putted and fails to drop in the cup, the ball must frequently be marked and picked up. The ball must then be replaced before the golfer putts or putts again. Finally, when the ball does drop in the cup, the ball must be retrieved.

The bending required for these actions presents a difficulty for the many golfers with back problems.

SUMMARY OF THE INVENTION

It is an object of the invention to allow the amount of bending in golf to be reduced.

The preceding object, as well as others which will become apparent as the description proceeds, are achieved by the invention.

One aspect of the invention resides in a golfing aid. The aid comprises an elongated member having a first end and a second end, and the first end is provided with golf ball holding means. The elongated member is further provided with means for releasing a golf ball from the holding means.

The holding means and releasing means provided on the elongated member of the invention make it possible to pick up and put down a golf ball with the member. Inasmuch as the member is elongated, these actions can be accomplished with little or no bending thereby allowing the amount of bending during a golf practice or game to be reduced.

Another aspect of the invention resides in a golfing method. The method comprises the steps of positioning a golf ball on or near the ground with an elongated member, releasing the golf ball from the elongated member, and lifting the golf ball from the ground with the elongated member.

The method can further comprise the steps of mounting a divot repair tool on the elongated member, creating a divot, removing the repair tool from the elongated member, and repairing the divot with the tool. At least part of the mounting step may be performed magnetically.

The method can additionally comprise the step of marking the golf ball with a marker between the releasing step and the lifting step, and the marking step is then performed using the elongated member.

The method may also comprise the step of mounting the marker on the elongated member, and such mounting is advantageously performed magnetically.

Additional features and advantages of the invention will be forthcoming from the following detailed description of preferred embodiments when read in conjunction with the accompanying drawings.

DESCRIPTION OF THE PREFERRED EMBODIMENTS

Figure 1:
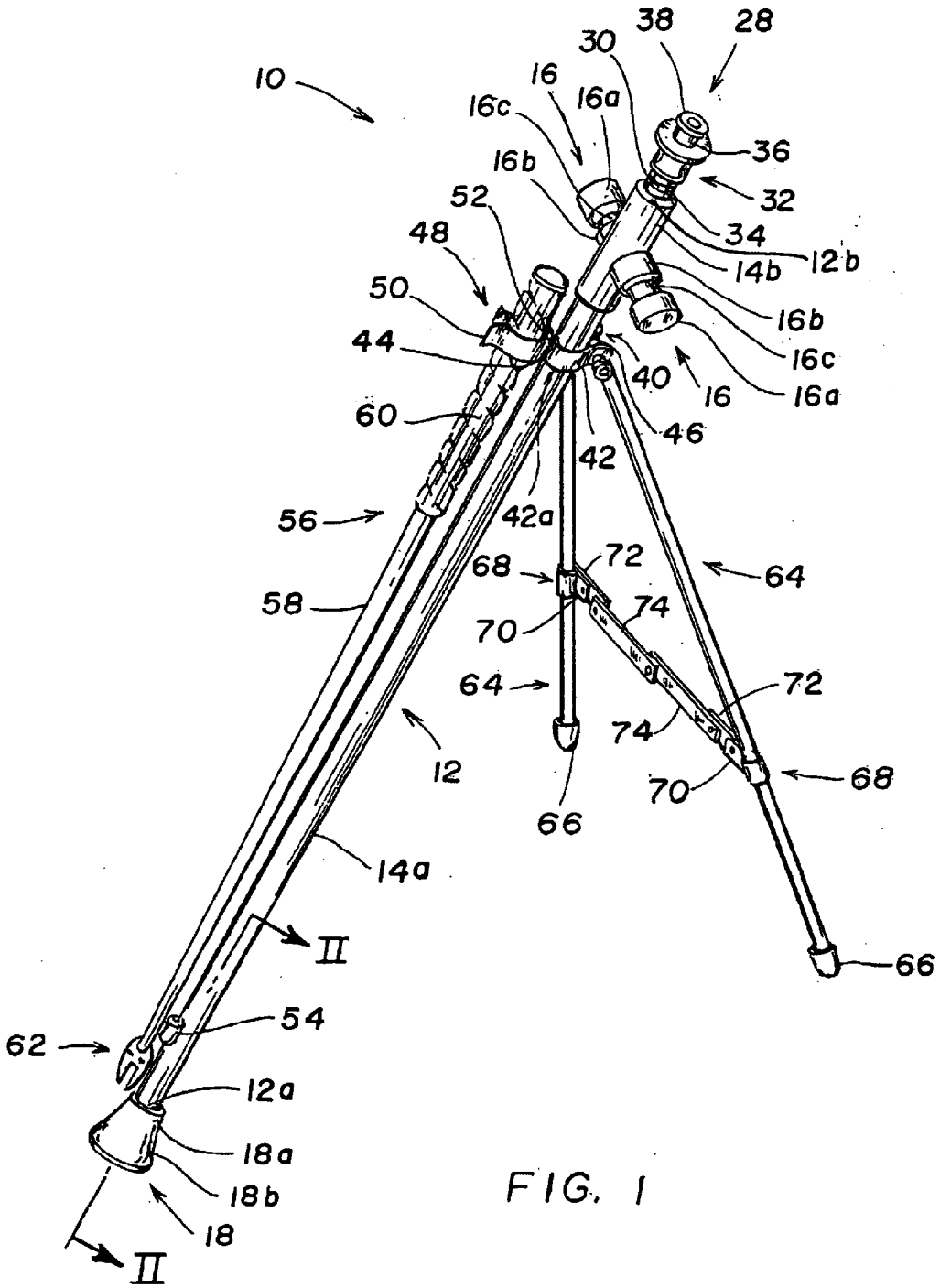
FIG. 1 is a perspective view of a golfing aid according to the invention.

Referring to FIG. 1, the numeral 10 identifies a golfing aid according to the invention. The golfing aid 10 includes an elongated member 12 having opposite longitudinal ends 12*a* and 12*b*. In use, the end 12*a* is located below the end 12*b* so that the end 12*a* may be considered a lower end of the elongated member 12 while the end 12*b* may be considered an upper end of the elongated member 12.

The elongated member 12 comprises a cylindrical section 14*a* of smaller diameter and a cylindrical section 14*b* of larger diameter.

The smaller cylindrical section 14*a* is disposed below the larger cylindrical section 14*b* during use, and the smaller cylindrical section 14*a* can accordingly be considered a lower section of the elongated member 12 whereas the larger cylindrical section 14*b* can be considered an upper section of the elongated member 12. The larger cylindrical section 14*b* is provided with a pair of handles 16 which project radially from diametrically opposite locations of the cylindrical section 14*b*. Each of the handles 16 has two radially spaced cylindrical portions 16*a* and 16*b* of equal diameter which are joined to one another by a cylindrical portion 16c of smaller diameter.

Figure 2:
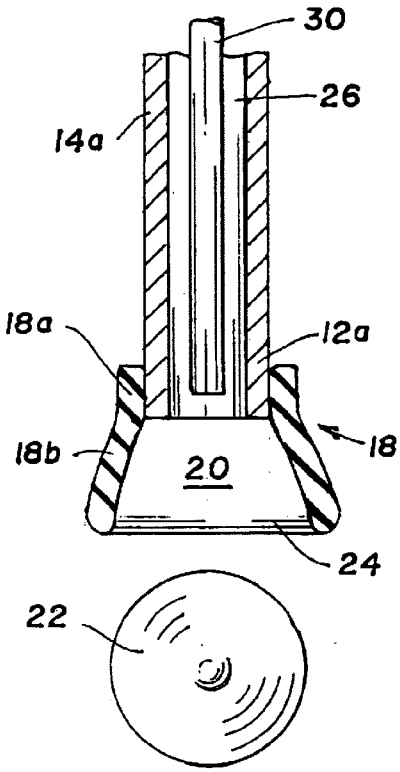
FIG. 2 is a fragmentary sectional view in the direction of the arrows II—II of FIG. 1 showing a retracted position of an ejecting element constituting part of the golfing aid of FIG. 1.
Figure 3:
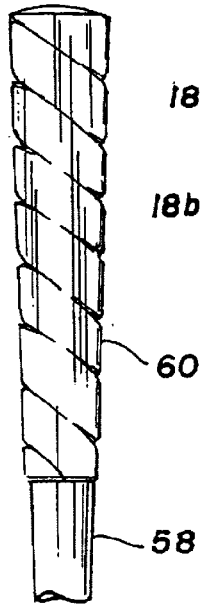
FIG. 3 is similar to FIG. 2 but shows an extended position of the ejecting member.
Figure 3:
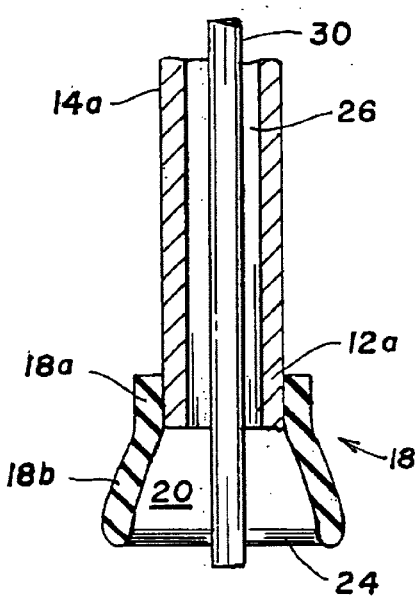

Turning to FIGS. 2 and 3 in conjunction with FIG. 1, a holding or gripping element 18 is mounted on the lower end 12*a* of the elongated member 12. The holding element 18 has an annular neck 18*a* which receives and frictionally grasps the lower end 12*a*. The holding element 18 further has a hollow frustoconical body 18*b* which widens in a direction away from the neck 18*a* and defines a pocket or cavity 20 designed to receive at least half of a golf ball 22. The frustoconical body 18*b* has an open end remote from the neck 18*a*, and an annular bead or rim 24 is formed internally of the frustoconical body 18*b* at this end. The bead 24 runs circumferentially of the open end of the frustoconical body 18*b* and has an inner diameter smaller than the diameter of the golf ball 22. The holding element 18 is resilient so that the frustoconical body 18*b* can expand when urged against the golf ball 22. This allows the golf ball 22 to enter the pocket 20 and be frictionally gripped by the bead 24. The holding element 18 can, for instance, be made of rubber.

The elongated member 12 is provided with a passage or channel 26 which runs longitudinally of the elongated member 12 from the lower end 12*a* to the upper end 12*b* thereof and is open at both ends 12*a*, 12*b*. An ejecting or releasing element 28 is mounted on the elongated member 12 and includes a rod-like or bar-like section 30 which extends through the passage 26 with clearance. One end of the rod-like or bar-like section 30, which will be referred to as the upper end of the section 30, projects from the upper end 12*b* of the elongated member 12. The upper end of the rod-like or bar-like section 30 is provided with a knob or head 32. The knob 32, which is always located externally of the passage 26, constitutes an exposed part of the ejecting element 28.

The ejecting element 28 is movable longitudinally of the elongated member 12 between a retracted position and an extended position. In the retracted position, the end of the rod-like or bar-like section 30 remote from the knob 32 is situated inside the smaller cylindrical section 14*a* of the elongated member 12 as shown in FIG. 2. The end of the rod-like or bar-like section 30 remote from the knob 32 can be considered the lower end of the section 30. As illustrated in FIG. 1, the knob 32 is disposed at a predetermined distance from the larger cylindrical section 14*b* of the elongated member 12 when the ejecting element 28 is in the retracted position.

In the extended position, the lower end of the rod-like or bar-like section 30 projects into the pocket 20 of the holding element 18 as can be seen in FIG. 3. The lower end of the rod-like or bar-like section 30 preferably extends to or beyond the bead 24 of the holding element 18 in the extended position. When the ejecting element 28 is in the extended position, the knob 32 is located nearer the larger cylindrical section 14*b* than in the retracted position. Thus, the knob 32 may be considered to be depressed.

The ejecting element 28 is urged towards the retracted position by a biasing element 34 which bears against the knob 32 and against the larger cylindrical section 14*b* of the elongated member 12. The biasing element 34 is here a spring.

When the golf ball 22 is to be gripped by the holding element 18, the ejecting element 28 is in the retracted position. Shifting of the ejecting element 28 to the extended position once the golf ball 22 is held by the holding element 18 causes the lower end of the rod-like or bar-like section 30 to contact the golf ball 22 and push the latter from the holding element 18. Hence, the lower end of the rod-like or bar-like section 30 can be referred to as an ejecting end.

At least part of the knob 32 is magnetic or magnetizable. In the illustrated embodiment, the surface of the knob 32 facing away from the elongated member 12 is formed with a magnetic or magnetizable button or protrusion 36 shown in FIG. 1. The magnetic or magnetizable button 36 serves to hold a magnetic or magnetizable golf ball marker 38 which is here in the form of a circular washer. The outer diameter of the washer 38 is larger than the diameter of the passage 26 as measured at the lower end 12*a* of the elongated member 12.

The rod-like or bar-like section 30, or at least the lower end thereof, is also magnetic or magnetizable. This allows the washer 32 to be mounted on the lower end of the rod-like or bar-like section 30. If the washer 32 is mounted on the lower end of the rod-like or bar-like section 30 in the extended position of the ejecting element 28 and the ejecting element 28 is then moved to the retracted position, the washer 38 drops off the lower end of the rod-like or bar-like section 30. Thus, since the outer diameter of the washer 38 is larger than the diameter of the passage 26 as measured at the lower end 12*a* of the elongated member 12, the washer 38 is unable to follow the lower end of the rod-like or bar-like section 30 as such end retracts into the passage 26.

As seen in FIG. 1, a yoke 40 is mounted on the smaller cylindrical section 14*a* of the elongated member 12 closer to the larger cylindrical section 14*b* than to the lower end 12*a*. The yoke 40 is generally U-shaped and has two arms 42 located on diametrically opposite sides of the smaller cylindrical section 14*a*. The arms 42 are connected to one another by a crosspiece or bridging element 44 15 running across a third side of the smaller cylindrical section 14*a*. Each of the arms 42 extends from the crosspiece 44 to a fourth side of the smaller cylindrical section 14*a* where the respective arm 42 has a free end. The free ends of the arms 42 have respective openings which register with one another and receive a threaded bolt 46 designed to mesh with the arms 42. The bolt 42 functions to spread and close the arms 42 so as to adjust the grip of the arms 42 on the smaller cylindrical section 14*a*. The arms 42 are provided with concavities 42*a* which allow the arms 42 to conform to the curvature of the smaller cylindrical section 14*a*.

A resilient clamp or clamping element 48 is secured to the crosspiece 44 of the yoke 40. The clamp 48 is generally U-shaped and comprises a pair of curved arms 50 which are joined to each other by a bridge or crosspiece 52 connected to the yoke crosspiece 44. The clamp arms 50 extend away from the clamp bridge 52 and the yoke crosspiece 44 in a diametrically opposite direction from the yoke arms 42.

The clamp arms 50 have free ends remote from the clamp bridge 52, and the free ends define an opening through which an object can be passed. The clamp legs 52 are capable of being resiliently spread apart to allow an object of greater width than the opening to pass through the latter. Once the object has passed through the opening, the clamp legs 52 can close to grip the object.

The curvatures of the clamp legs 52 are such that the surfaces of the legs 52 which face one another are concave. This enables the clamp legs 52 to firmly grip curved objects.

A magnetic or magnetizable button or protuberance 54 is mounted on the smaller cylindrical section 14*a* of the elongated member 12 closer to the lower end 12*a* than to the larger cylindrical section 14*b*. The magnetic or magnetizable button 54 and the clamp 48 together constitute a means for holding or retaining a divot repair tool 56 on the elongated member 12.

Figure 4:
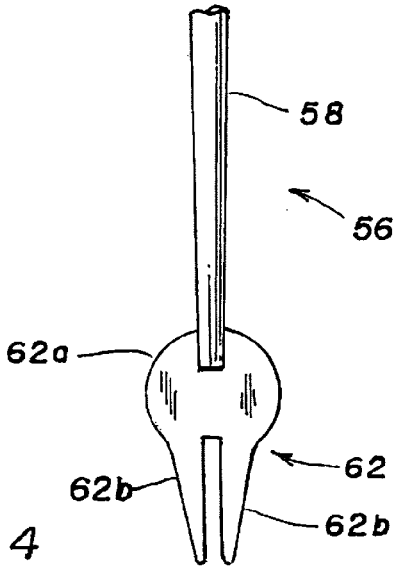
FIG. 4 is an elevational front view of a divot repair tool forming part of the golfing aid of FIG. 1.

Considering FIG. 4 together with FIG. 1, the divot repair tool 56 includes an elongated frustoconical shaft 58 which is magnetic or magnetizable. One end of the shaft 58 is provided with a frustoconical jacket or sheath 60 which allows the shaft 58 to be firmly gripped. The jacket 60 can, for example, be made of rubber. The other end of the shaft 58 is equipped with a divot repair head 62 of sheet material. The repair head 62 comprises a mounting portion 62*a* which extends into a slot formed in, and is fixed to, the shaft 58. The repair head 62 further comprises a pair of tines 62*b* which project from the mounting portion 62*a* away from the shaft 58 in longitudinal direction thereof.

FIG. 1 shows the divot repair tool 56 mounted on the elongated member 12. As seen in FIG. 1, the clamp 48 and the magnetic or magnetizable button 54 are separated by a distance such that the shaft 58 of the repair tool 56 can rest on the button 54 when the jacket 60 of the repair tool 56 is held by the clamp 48. To mount the repair tool 56 on the elongated member 12, the jacket 60 is urged into the clamp 48 and the magnetic or magnetizable shaft 58 is brought into abutment with the button 54.

Two support legs 64, which can be in the form of rods or bars, are mounted on the elongated member 12. Each of the support legs 64 has an end which is designed to rest on the ground, and each such end is provided with a cap 66. The opposite end of each support leg 64 is formed with an eye 68, and each of the eyes is located to the outside of a respective arm 42 of the yoke 44 and receives the bolt 46 which connects the yoke arms 42 to one another. The bolt 46 extends through the eyes with clearance so that the support legs 64 can pivot towards and away from the elongated member 12. When the support legs 64 are swung away from the elongated member 12 as in FIG. 1, the elongated member 12 and the support legs 64 can be stood on the ground with the support legs 64 holding the elongated member 12 in an inclined position. The support legs 64 can be swung to locations adjacent the elongated member 12 to facilitate carrying of the golfing aid 10.

Each of the support legs 64 is provided with a yoke 68 which encircles and is fixed to the respective leg 64. The yoke 68 on each support leg 64 has a pair of short arms 70 extending towards the other leg 64. The arms 70 of each pair are arranged side-by-side in abutment with one another and are fixed to a short bar 72 having an end remote from the respective arms 70. This end of each bar 72 is pivotally connected to one end of a lever 74, and the opposite ends of the levers 74 are pivotally connected to one another. The levers 74 form a hinge which allows the support legs 64 to be spread apart and folded. The support legs 64 are spread apart as in FIG. 1 when the golfing aid 10 is to stand on the ground with the support legs 64 supporting the elongated member 12. The support legs 64 are folded to make it more convenient to carry the golfing aid 10.

One manner of operation of the golfing aid 10 will be described assuming that a golfer has hit the golf ball 22 onto a green.

The golfer approaches the ball 22 with the golfing aid 10 in hand. At this time, the support legs 64 are folded and the ejecting element 28 is in its retracted position due to the biasing action of the spring 34. The golfer removes the washer 38 from the button 36 and turns the elongated member 12 on its side or upside down so that she or he can reach the holding element 18. The golfer then depresses the knob 32 of the ejecting element 28 to move the latter to its extended position. This action makes the magnetic or magnetizable lower end of the rod-like or bar-like section 30 of the ejecting element 28 accessible to the golfer who places the washer 38 on the lower end of the rod-like or bar-like section 30. The golfer thereupon positions the holding element 18 and the lower end of the rod-like or bar-like section 30 adjacent to the ball 22 while maintaining the ejecting element 28 in its extended position once the holding element 18 and the lower end of the rod-like or bar-like section 30 have been positioned adjacent to the ball 22, the golfer releases the knob 32. This allows the spring 34 to return the ejecting element 28 to its retracted position. As the ejecting element 28 approaches the retracted position, the lower end of the rod-like or bar-like section 30 enters the passage 26 in the elongated member 12. Since the washer 38 is too large to enter the passage 26, the washer 38 drops off the rod-like or bar-like section 30 and onto the ground adjacent the ball 22. Consequently, the ball 22 is marked.

The golfer next places the holding element 18 on the ball 22 and pushes down sufficiently hard to cause the holding element 18 to grip the ball 22. When the ball 22 has been gripped by the holding element 18, the golfer lifts the golfing aid 10 to remove the ball 22 from the green. If desired, the ball 22 can remain in the holding element 18 while the golfer awaits her or his turn to putt. Otherwise, the golfer can turn the elongated member 12 on its side or upside down and retrieve the ball 22 from the holding element 18.

The length of the elongated member 12 is such that the golfer can mark and pick up the ball 22 with little or no bending.

The support legs 64 can be swung away from the elongated member 12 and spread to permit placement of the golfing aid 10 on the ground while the golfer waits to putt. This can be done whether the ball 22 remains in the holding element 18 or not.

When it is the golfer's turn to putt, the golfer folds the support legs 64 and lifts the golfing aid 10. If the ball 22 was removed from the holding element 18 after being picked up from the green, the golfer now turns the elongated member 12 onto its side or upside down and reinserts the ball 22 in the holding element 18. The holding element 18 is positioned with the ball 22 just above or touching the green at a location adjacent to the marker 18. The knob 32 is then depressed to move the ejecting element 28 to its extended position. Movement of the ejecting element 28 to the extended position causes the ball 22 to be expelled from the holding element 18 in proximity to the washer 38. After the ball 22 has been returned to the green, the golfer continues to hold the ejecting element 28 in its extended position and places the lower end of the rod-like or bar-like section 30 on the washer 38. The golfer thereupon lifts the golfing aid 10 while maintaining the ejecting element 28 in its extended position. Inasmuch as the washer 38 is magnetically attracted to the lower end of the rod-like or bar-like section 30, the washer 38 is picked up from the green when the golfer lifts the golfing aid 10. With the ejecting element 28 still in the extended position, the golfer turns the elongated member 12 onto its side or upside down and retrieves the washer 38 from the rod-like or bar-like section 30. The golfer subsequently allows the ejecting element 28 to return to its retracted position and replaces the washer 38 on the button 36.

Replacement of the ball 22 on the marked location of the green, as well as retrieval of the washer 38 from the green, can again be accomplished with little or no bending by the golfer.

Once the washer 38 has been put back on the button 36, the golfer spreads the support legs 64 and stands the golfing aid 10 on the ground. The golfer can then putt the ball 22. If the golfer misses the cup and must mark again, the above procedure is repeated. On the other hand, if the golfer sinks the putt, the golfer folds the support legs 64 and retrieves the ball 22 from the cup by capturing the ball 22 with the holding element 18.

Whenever the golfer creates a divot requiring repair, the golfer removes the divot repair tool 56 from the clamp 48 and the magnetic or magnetizable button 54. Grasping the jacket 60 of the repair tool 56, the golfer then smoothens the divot with the divot repair head 62. After the divot has been smoothed, the repair tool 56 is replaced by pushing the jacket 60 into the clamp 48 and positioning the shaft 58 on the button 54.

The golfing aid 10 can also be used to position the ball 22 for a tee shot.

The golfing aid 10 allows the golf ball 22 and the washer 38 serving as a marker to be placed on the ground and picked up with little or no bending. Similarly, a divot created by a golfer can be smoothed with little or no bending with the divot repair tool 56. Accordingly, the strain on the back of a golfer can be reduced.

Moreover, since the golfing aid 10 is capable of holding the washer 38 and the divot repair tool 56, these items are always readily accessible to a golfer and are not likely to be lost or misplaced.

In the same way, the holding element 18 provides a convenient storage location for the golf ball 22.

Various modifications are possible within the meaning and range of equivalence of the appended claims.

I claim:

1. A golfing aid comprising:

an elongated, member having a first end and a second end, said first end being provided with golf ball holding means, and said elongated member further being provided with means for releasing a golf ball from said holding means and means for retaining a divot repair tool;

and a divot repair tool held by said retaining means, said repair tool including an elongated shaft having opposite ends and a divot repair element at one of said ends of said shaft.

2. The aid of claim 1, wherein said releasing means comprises an ejecting element having a rod-like or bar-like section which extends through said elongated member longitudinally thereof, said ejecting element being movable longitudinally of said elongated member between a retracted position and an extended position, and said ejecting element being arranged to eject a golf ball from said holding means upon movement from said retracted position to said extended position.

3. The aid of claim 1, wherein said retaining means comprises a clamping element.

4. The aid of claim 1, wherein said retaining means comprises a magnetic or magnetizable element.

5. A golfing aid comprising:

an elongated member having a first end and a second end, said first end being provided with golf ball holding means, and said elongated member further being provided with means for releasing a golf ball from said holding means, at least one of said elongated member, said holding means and said releasing means having a first golf ball marker holding portion for storing a golf ball marker, and at least one of said elongated member, said holding means and said releasing means having a second golf ball marker holding portion for depositing a golf ball marker on and retrieving a golf ball marker from the ground.

6. The aid of claim 5, wherein said holding means comprises a gripping element having a resilient portion which defines a pocket, said pocket being sized to frictionally grip a golf ball.

7. The aid of claim 5, wherein said first holding portion is magnetic or magnetizable to hold a magnetic or magnetizable golf ball marker.

8. The aid of claim 7, wherein said releasing means comprises an ejecting element having a rod-like or bar-like section which extends through said elongated member longitudinally thereof, said ejecting element being movable longitudinally of said elongated member between a retracted position and an extended position, and said ejecting element being arranged to eject a golf ball from said holding means upon movement from said retracted position to said extended position, said ejecting element having an exposed part which includes said first holding portion and is located on a side of said second end remote from said first end.

9. The aid of claim 8, wherein said ejecting element has an ejecting end which includes said second holding portion and is arranged to strike a golf ball in said holding means upon movement of said ejecting element from said retracted position to said extended position, said second holding portion being magnetic or magnetizable.

10. The aid of claim 5, wherein said elongated member is provided with a handle.

11. The aid of claim 5, wherein said second holding portion is located in the region of said first end.

12. The aid of claim 5, further comprising a golf ball marker, said marker being disk-like.

* * * * *